US005602069A

United States Patent [19]

Wisniewski et al.

[11] Patent Number: 5,602,069

[45] Date of Patent: Feb. 11, 1997

[54] GLASS CLEANING COMPOSITION

[75] Inventors: Karen Wisniewski, Bound Brook, N.J.; Guy Broze, Grace-Hollogne; Anne-Marie Misselyn, Villers-l'eveque, both of Belgium

[73] Assignee: Colgate-Palmolive Co., Piscataway, N.J.

[21] Appl. No.: 323,335

[22] Filed: Oct. 14, 1994

[51] Int. Cl.[6] ..... C11D 1/82

[52] U.S. Cl. ..... 502/182; 502/163

[58] Field of Search ..... 252/173, 174.15, 252/544, DIG. 7, DIG. 10, DIG. 14; 510/182, 163, 181

[56] References Cited

U.S. PATENT DOCUMENTS

| | | | |
|---|---|---|---|
| 3,249,550 | 5/1966 | Metters | 252/161 |
| 3,939,090 | 2/1976 | Zmoda | 252/90 |
| 4,158,644 | 6/1979 | Hammerel | 252/547 |
| 4,374,745 | 2/1983 | Sibley et al. | 252/106 |
| 5,043,088 | 8/1991 | Falla | 252/70 |
| 5,254,284 | 10/1993 | Barone et al. | 252/174.15 |
| 5,342,534 | 8/1994 | Shrobala et al. | 252/91 |
| 5,454,983 | 10/1995 | Michael et al. | 252/545 |

*Primary Examiner*—Glenn A. Caldarola
*Assistant Examiner*—Alexander G. Ghyka
*Attorney, Agent, or Firm*—Richard E. Nanfeldt; James Serafino

[57] ABSTRACT

The present invention relates to a glass cleaning composition comprising a silicone glycol, a zwitterionic or anionic surfactant, an aliphatic alcohol, a monoalkyl ether of a glycol and water.

6 Claims, No Drawings

GLASS CLEANING COMPOSITION

FIELD OF THE INVENTION

This invention relates a glass cleaning composition having improved sheeting action and non-streaking properties.

BACKGROUND OF THE INVENTION

There are numerous commercially available glass cleaning compositions which employ water, water soluble organic solvents and surfactants. However, these commercially available glass cleaning compositions are inferior in sheeting action or non-streaking properties as compared to the instant compositions. The prior art describes numerous glass cleaning compositions.

U.S. Pat. No. 4,690,779 teaches a non-streaking glass cleaning composition comprising a betaine surfactant, polyethylene glycol, an ether type solvent, sodium salt of ethylene diamine tetraacetic acid and water.

U.S. Pat. No. 5,342,549 teaches a non-streaking hard surface cleaning composition comprising a hydrocarbylamido alkylenebetaine, a solvent having an HLB of less than 7.7, a buffering system and water.

U.S. Pat. No. 3,933,407 relates to an antifogging coating which comprises a hydroxyalkyl acrylate and an organisiloxane-oxyalkylene block copolymer.

U.S. Pat. No. 3,939,090 relates to an antifogging cleaning composition comprising an ethylenically unsaturated polymeric anhydride or partial ester, an alkylene glycol lower alkyl monoether; an aliphatic alcohol, an ethoxylated alkyl ether sulfate and water.

Canadian Patent No. 714,521 relates to a glass cleaning composition comprising dimethyl polysiloxane, an aliphatic alcohol, a glycol or glycol ether, water and a nonionic or anionic surfactant.

U.S. Pat. No. 5,254,284 teaches a glass cleaning composition having antifogging properties. The composition comprises a silicone glycol, xanthan gum, a glycol ether, a nonionic surfactant and water.

SUMMARY OF THE INVENTION

The present invention relates to a glass cleaning composition having improved non-streaking properties as well as sheeting properties, wherein the composition comprises an aliphatic alcohol, a glycol ether, an anionic or zwitterionic surfactant, a silicone glycol and water.

DETAILED DESCRIPTION OF THE INVENTION

The glass cleaning compositions which have improved sheeting properties and non-streaking properties comprise approximately by weight:

(a) 2% to 15% of an aliphatic alcohol;

(b) 0 to 10% of a monoalkyl ether of a glycol;

(c) 0.05% to 1.0% of an anionic surfactant or a zwitterionic surfactant;

(d) 0.05% to 1.5% of a silicone glycol;

(e) 0 to 0.1% of a perservative;

(f) 0 to 0.4% of an alkyl benzyl dimethyl ammonium chloride wherein the alkyl group has 10 to 18 carbon atoms;

(g) the balance being water, wherein the composition has a viscosity at 25° C. of about 1 to about 20 cps and the composition is free of hydrophilic polymeric thickeners such as xanthan gum.

The aliphatic alcohols are used in the instant compositions at a concentration level of about 2 wt. % to 15 wt. %, more preferably 3 wt. % to 7 wt. %, wherein the aliphatic alcohol has about 1 to about 4 carbon. An especially preferred aliphatic alcohol is isopropyl alcohol.

The monoalkyl ethers of a glycol are used in the instant compositions at a concentration of about 0 to 10 wt. %, more preferably about 1 wt. % to about 5 wt. %. The monoalkyl ethers of the glycols are characterized by the formula $$RO(X)_nH$$

wherein R is a $C_{1-4}$ alkyl group and X is selected from the group consisting of $CH_2CH_2O$, $CH(CH_3)CH_2O$ and $CH_2CH_2CH_2O$ and n is from 1 to 4.

Satisfactory glycol ethers are ethylene glycol monobutyl ether (butyl cellosolve), diethylene glycol monobutyl ether (butyl carbitol), triethylene glycol monobutyl ether, tetraethylene glycol monobutyl ether, propylene glycol tertiary butyl ether, propylene glycol n-butyl ether and propropylene glycol methyl ether, wherein propylene glycol n-butyl ether is especially preferred.

The anionic or zwitterionic surfactant are used in the instant composition at a concentration of about 0.05 wt. % to about 1.0 wt. %, more preferably 0.1 wt. % to 0.75 wt. %, wherein nonionic surfactants are explicitly excluded from the instant composition.

The anionic surfactant which may be used in the liquid detergent of the invention is water soluble such as triethanolamine salt and include the sodium, potassium, ammonium and ethanolammonium salt of: $C_8$–$C_{18}$ alkyl sulfates such as lauryl sulfate, myristyl sulfate and the like; linear $C_8$–$C_{16}$ alkyl benzene sulfonates; $C_{10}$–$C_{20}$ paraffin sulfonates; alpha olefin sulfonates containing 10–24 carbon atoms; and $C_8$–$C_{18}$ ethoxylated alkyl ether sulfates. Preferred anionic surfactants are the water soluble $C_{12}$–$C_{16}$ alkyl sulfates, the $C_{10}$–$C_{15}$ alkylbenzene sulfonates, the $C_{12}$–$C_{17}$ paraffin sulfonates, $C_8$–$C_{18}$ ethoxylated alkyl ether sulfates and the alpha $C_{12}$–$C_{18}$ olefin sulfonates.

One of the anionic surfactants which can be used in the instant composition is a metal salt of an ethoxylated alkyl ether sulfate which is depicted by the formula:

$$R—(OCHCH_2)_nOSO_3^-M^+$$

wherein n is 1 to 22 more preferably 1 to 3 and R is an alkyl group having 8 to 18 carbon atoms, more preferably 12 to 15 and natural cuts, for example, $C_{12-14}$; $C_{12-15}$ and M is a metal cation most preferably sodium and n is 1 to 3. The solubilizing agent is present in the composition at a concentration of 0.5 to 8.0 wt. %, more preferably 1.0 to 7.0 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

The paraffin sulfonates may be monosulfonates or disulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 10 to 15 or 16 carbon atoms in the higher alkyl group in a straight or branched chain, or $C_{8-15}$ alkyl toulene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example, 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

One of the water-soluble zwitterionic surfactants, which can be used in the present liquid glass cleaning composition, constitutes 0.05 to 1%, preferably 0.2 to 0.5%, by weight and provides good foaming properties and mildness to the glass cleaning. The zwitterionic surfactant is a water soluble betaine having the general formula:

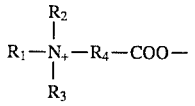

wherein $R_1$ is an alkyl group having 10 to 20 carbon atoms, preferably 12 to 16 carbon atoms, or the amido radical:

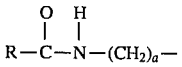

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonio) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyldimethyl betaine.

Another preferred zwitterionic surfactant used in the instant composition is an alkyl amido alkylhydroxy sultaine depicted by formula:

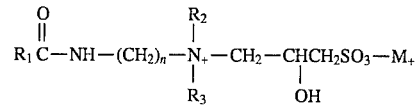

wherein $R_1$ is an alkyl group having 10 to 20 carbon atoms, preferably 12 to 16 carbon atoms, or the amido radical:

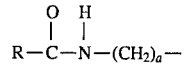

wherein R is an alkyl group having 9 to 19 carbon atoms and a is the integer 1 to 4; $R_2$ is a methyl or ethyl group, $R_3$ is a methyl or ethyl group, n is about 1 to about 6, and $M^+$ is an alkali metal cation. The most preferred hydroxysultaines are a potassium or sodium salt of cocoamidopropyl hydroxysultaine.

Another zwitterionic surfactant is a fluorobetaine characterized by the formula $$R_fCH_2CH(OCOCH_3)CH_2N^+(CH_3)_2—CH_2CO_2$$

wherein $R_f$ is equal to $F(CF_2CF_2)n$ wherein n is 3 to 8.

The silicone glycols used in the instant glass cleaning compositions are used at a concentration of about 0.05 wt. % to more 1.5 wt. %, preferably from about 0.1 wt. % to about 0.5 wt. % weight basis. Concentrations above about 1% are not recommended since hazing and streaking problems can occur at these levels. The silicone glycols described in previously mentioned U.S. Pat. No. 5,254,284, which is incorporated herein by reference, are suitable for use in the present invention. Preferred compositions are depicted by the formula:

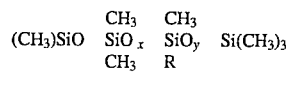

wherein R is $$CH_2CH_2CH_2O\ (CH_2CH_2O)_P\ (CH_2CH(CH_3)O)_Q\ R^1$$

and $R^1$ is H or an alkyl having 1 to 4 carbon atoms. The hydrophile-lipophile balance can be adjusted by varying the ethylene oxide (EO): propylene oxide (PO) content of the R chain. The value of X will typically be about 1 to about 50, preferably from 10 to 30, the value of Y being from about 1 to about 22, preferably from about 5 to about15. P is from about 1 to about 62, preferably about 15 to about 45 and Q is about 1 to about 90, preferably about 25 to about 60. The molecular weight of the silicone glycol is about 2,000 to 4,000. An especially preferred silicone glycol is Dow Corning 190 or 193 surfactant.

The balance of the composition is water, wherein various other minor ingredients can be added to the composition. The composition can contain 0 to 0.1 wt. %, more preferably 0.01 wt. % to 0.09 wt. % of a perfume. The composition can also contain a dye at a concentration level of 0 to 0.02 wt. %. The composition can also contain about 0 to about 0.1 wt. % of a perservative such as EDTA or a germicidal quaternary surfactant.

The pH of the composition is about 6.5 to about 8 and is achieved by adding, if necessary, the necessary amount of sodium potassium or ammonium hydroxide, or magnesium oxide.

The following examples which are in wt. % are merely illustrative of the instant invention and are not to be construed as limiting thereof.

EXAMPLE 1

The following compositions were made at 25° C. by a simple liquid mixing method.

| | A | B | C | D | E | P&G Cinch | SC Johnson Windex |
|---|---|---|---|---|---|---|---|
| Isopropyl alcohol | 6 | 6 | 6 | 6 | 6 | | |
| Propylene glycol mono n-butyl ether | 2.5 | 2.5 | 2.5 | 2.5 | 2.5 | | |
| Cocoamido propyl hydroxy sultaine | | 0.3 | | | 0.3 | | |
| Cocoamido propyl betaine | | | 0.3 | | | | |
| Fluoro betaine | | | | 0.3 | | | |
| $C_{14-17}$ paraffin sulfonate | 0.3 | | | | | | |
| Dow Corning 193 surfactant | 0.3 | 0.3 | 0.3 | 0.3 | 0.3 | | |
| Alkylbenzyl dimethyl ammonium chloride | | | | | 0.2 | | |
| Perfume | 0.1 | 0.1 | 0.1 | 0.1 | 0.1 | | |
| Water | Balance | Balance | Balance | Balance | Balance | | |
| Clarity | Clear | Clear | Clear | Clear | Clear | | |
| Streaking | 10 | 10 | 10 | 8 | 8 | 9 | 10 |
| Sheeting action | 5 | 10 | 9 | 10 | 10 | 4 | 2 |

The streaking is rated visually on a scale of 1 to 10 with 10 being the least streaking and 1 being the worst streaking.

The sheeting action is rated on a scale of 1 to 10 with 10 being the best sheeting action and 1 being the worst sheeting action.

What is claimed is:

1. A glass cleaning composition consisting essentially of approximately by weight:

(a) 2% to 15% of an aliphatic alcohol having about 1 to about 4 carbon atoms;

(b) 0 to 10% of a monoalkyl ether of a glycol;

(c) 0.05% to 1.0% of a zwitterionic, said zwitterionic surfactant being selected from the group consisting of betaines and sultaines;

(d) 0.05 to 1.5% of a silicone glycol; and (e) the balance being water, said composition having a viscosity at 25° C. of 1 to 25 cps and being free of xanthan gum and has a pH of 6.5 to 8.0.

2. A composition according to claim 1 wherein the silicone glycol is characterized by the formula:

$$\begin{matrix} CH_3 & CH_3 & & & & & \\ (CH_3)SiO & SiO_x & SiO_y & Si(CH_3)_3 & & & \\ CH_3 & R & & & & & \end{matrix}$$

wherein R is $$CH_2CH_2CH_2O\ (CH_2CH_2O)_P\ (CH_2CH(CH_3)O)_o\ R^1$$

wherein $R^1$ is H or alkyl group of 1 to 4 carbon atoms wherein X is about 1 to about 50; Y is about 1 to about 22; p is about 1 to about 62 and Q is about 25 to about 60.

3. The composition according to claim 2, wherein said aliphatic alcohol has about 1 to about 4 atoms.

4. The composition according to claim 3, wherein said monoalkyl ether of said glycol is characterized by the formula $$RO(X)_nH$$

wherein R is a $C_{1-4}$ alkyl group, X is selected from the group consisting of $CH_2CH_2O$, $CH_2CH_2CH_2O$ and $CH(CH_3)CH_2O$ and n is from 1 to 4.

5. The composition according to claim 4, wherein said monoalkyl ether of said glycol is propylene glycol n-butyl ether and said aliphatic alcohol is isopropyl.

6. The composition according to claim 1, wherein said surfactant is selected from the group consisting of fluorobetaine, paraffin sulfonate, alkyl amido alkyl hydroxy sultaine and an alkyl dimethyl betaine.

* * * * *